US005224659A

United States Patent [19]

Gabardi

[11] Patent Number: 5,224,659

[45] Date of Patent: Jul. 6, 1993

[54] APPARATUS FOR FEEDING GRINDING BALLS

[75] Inventor: Thomas L. Gabardi, Salt Lake City, Utah

[73] Assignee: Control International, Salt Lake City, Utah

[21] Appl. No.: 839,637

[22] Filed: Feb. 21, 1992

[51] Int. Cl.[5] ..... B02C 23/02

[52] U.S. Cl. ..... 241/34; 241/171; 221/13; 221/298

[58] Field of Search ..... 241/171, 34; 221/298, 221/295, 13

[56] References Cited

U.S. PATENT DOCUMENTS

| | | | |
|---|---|---|---|
| 2,592,783 | 4/1952 | Aspegren | 241/171 X |
| 3,401,893 | 9/1968 | Reynolds | 241/171 |
| 3,602,403 | 8/1971 | Klem | 221/298 X |
| 3,690,570 | 9/1972 | Root | 241/34 |
| 3,773,268 | 11/1973 | Bond | 241/34 X |
| 3,783,252 | 1/1974 | Putman | 241/34 X |
| 3,999,753 | 12/1976 | Desilets . | |
| 4,065,061 | 12/1977 | Bombled | 241/171 X |
| 4,198,006 | 4/1980 | Rolfe | 241/37 X |
| 4,289,254 | 9/1981 | Spring . | |
| 4,457,194 | 7/1984 | Mally . | |
| 4,715,546 | 12/1987 | Holming et al. . | |

FOREIGN PATENT DOCUMENTS

| | | | |
|---|---|---|---|
| 216428 | 7/1968 | U.S.S.R. . | |
| 301208 | 6/1971 | U.S.S.R. | 241/298 |

*Primary Examiner*—Mark Rosenbaum
*Assistant Examiner*—Frances Chin
*Attorney, Agent, or Firm*—R. J. Bunyard; L. A. Fillnow; R. H. Johnson

[57] ABSTRACT

Apparatus for feeding balls to a grinding mill. The apparatus includes a downwardly inclined chute (12) adapted to receive balls from a bin or hopper, the chute for delivering the balls to the grinding mill and means (20) for sequentially feeding the balls, one-at-a-time, to the grinding mill. The feeding means includes a first actuator (22) and a second actuator (26). Each of the actuators preferably includes an extension arm (24 and 28 respectively) mounted for rotation along the longitudinal axis of the chute. The first actuator is for restraining balls from traveling down the chute and works in conjunction with the second actuator for isolating the lowermost ball in the chute to be fed next to the grinding mill. The second actuator is for releasing the isolated ball. The feeding means may include a computer controller (90) for operating each of the actuators at a predetermined time interval corresponding to the ball attrition rate of the grinding mill. A magnetic sensor (84) may be positioned inside the chute downstream from the actuators for sensing passage of the isolated ball through the chute for providing feedback to the controller.

5 Claims, 7 Drawing Sheets

APPARATUS FOR FEEDING GRINDING BALLS

BACKGROUND OF THE INVENTION

This invention relates to an apparatus for gravity feeding balls to a grinding mill. More particularly, the invention relates to an apparatus for sequentially feeding grinding balls one-at-a-time to a grinding mill at a controlled rate.

Grinding mills are used to reduce the size of solid materials in tumbling mills during mineral processing of ores. The size reduction is accomplished by the tumbling action of grinding media during rotation of the mill. Grinding media may be spherically shaped such as balls, non-spherically shaped such as cylinders or cones or some combination thereof. Traditionally, grinding media is intermittently fed to a mill using a dump bucket and the like. More recently, automatic feeders have been used with the feeders supplying controlled amounts of grinding media at timed intervals. U.S. Pat. No. 4,715,546 discloses an apparatus for storing and feeding multiple balls of limited sizes to a grinding mill. A drum having small compartments is positioned in-line with a downwardly inclined chute. As the drum is continuously rotated at a preset speed, an empty compartment on the upstream side of the drum is filled with balls from the chute while another compartment on the downstream side of the drum discharges a similar amount of balls into the grinding mill. Rotating feeders have a disadvantage that ball pieces tend to become wedged between the rotating feeder and the inclined chute. A jammed ball piece causes the feeder to lock and the jammed piece can not be freed by rotating the feeder in the reverse direction. Further, if the jammed ball piece is inaccessible, the rotating feeder must be disassembled thereby causing a unit stoppage.

Rotating or star feeders also are limited to the ball sizes that can be used because the ball compartments have a specific size. Balls too small for a specific compartment tend to bridge in the compartments, in effect clogging the compartments. This changes the addition rate since fewer balls are fed during each revolution. On the other hand, balls that are too large in diameter will not fit into the compartments thus causing the feeder either to slip against the balls in the chute or to lock in place and possibly burn out the feeder motor. Thus, various size star feeder assemblies must necessarily be manufactured and used according to the particular ball sizes being used.

Changing the size of a rotating feeder assembly also may require the width of the inclined chute to be changed. Because multiple balls are fed from the storage bin to the feeder assembly, the balls will be positioned side-by-side in the chute. This side-by-side positioning may cause the balls to bridge in the chute when the ball diameter ratio changes significantly. That is, the likelihood of balls jamming in the chute increases as the ball diameter to chute width ratio increases.

Russian patent 216,428 discloses a device for feeding grinding balls. The device includes a pneumatically operated cylinder having an upper cover adapted for receiving balls, a downwardly inclined first chute filled with balls and a downwardly inclined second chute for delivering balls to a grinding mill. The pneumatic cylinder is passed upwardly through the first chute picking up balls with the balls then being transferred to the second chute. This ball feeder has the disadvantages that balls are not fed one-at-a-time, fed balls are not monitored and balls tend to jam as the first chute is raised. If a jammed condition does occur, the potential for damage is increased because the pneumatic cylinder will continue attempting to raise the first chute causing the pressure in the cylinder to continue increasing until failure occurs.

Accordingly, there remains a need for an apparatus for feeding grinding balls into a grinding mill wherein the potential for jamming by the balls or the feeder mechanism is minimized. There also remains a need for an apparatus that can monitor and control the feed rate of grinding balls.

BRIEF SUMMARY OF THE INVENTION

The invention relates to an apparatus for feeding balls into a grinding mill. The apparatus includes a downwardly inclined chute adapted to receive the balls from a storage means, the chute for delivering the balls to the grinding mill and means for sequentially feeding the balls, one-at-a-time, through the chute. The feeding means includes first and second actuators. The first actuator is for restraining balls from traveling down the chute and for working in conjunction with the second actuator for isolating the next ball to be fed to the grinding mill. The second actuator is for releasing the isolated ball to the grinding mill.

In a preferred embodiment, each of the actuators includes an extension arm mounted for rotation in a plane parallel to the axis of the chute with the actuators being controlled by an electronic signal from a computer controller operated at a predetermined time interval corresponding to the ball attrition rate of the grinding mill. A magnetic sensor is positioned inside the chute downstream from the actuators for sensing passage of the isolated steel or iron ball through the chute thereby providing feedback to the controller.

The principal object of the invention is to provide an apparatus for sequentially gravity feeding balls, one-at-a-time, to a grinding mill.

Other objects of the invention include an apparatus that can monitor the rate of balls being fed to a grinding mill and an apparatus that can provide feedback relating to the success or failure of ball additions to a grinding mill.

The invention includes an apparatus for feeding balls into a grinding mill including a downwardly inclined chute for delivering balls from a storage means to the grinding mill, means for sequentially feeding the balls one-at-a-time, the feeding means including first and second actuators, the first actuator for restraining balls from traveling down the chute and for working in conjunction with the second actuator for isolating the next ball to be fed to the grinding mill and the second actuator for releasing the isolated ball.

Another feature of the invention is for the aforesaid actuators to be controlled by an electronic signal.

Another feature of the invention is for the aforesaid chute to include means for sensing passage of the isolated ball to the grinding mill.

Another feature of the invention is for each of the aforesaid actuators to include an extension arm mounted for rotation in a plane parallel to the longitudinal axis of the chute.

Advantages of the invention include the ability to monitor and control the addition of balls to a grinding mill, the ability to adjust the ball feeding apparatus to accommodate changes in ball sizes and the ability to retrofit the apparatus to an existing ball storage means. Additional advantages include minimizing jamming of balls or ball pieces within the feed chute and being able to access any area within the chute to remove a jammed ball or ball piece.

The above and other objects, features and advantages of the invention will become apparent upon consideration of the detailed description and appended drawings.

DETAILED DESCRIPTION OF THE PREFERRED EMBODIMENT

Figure 1:
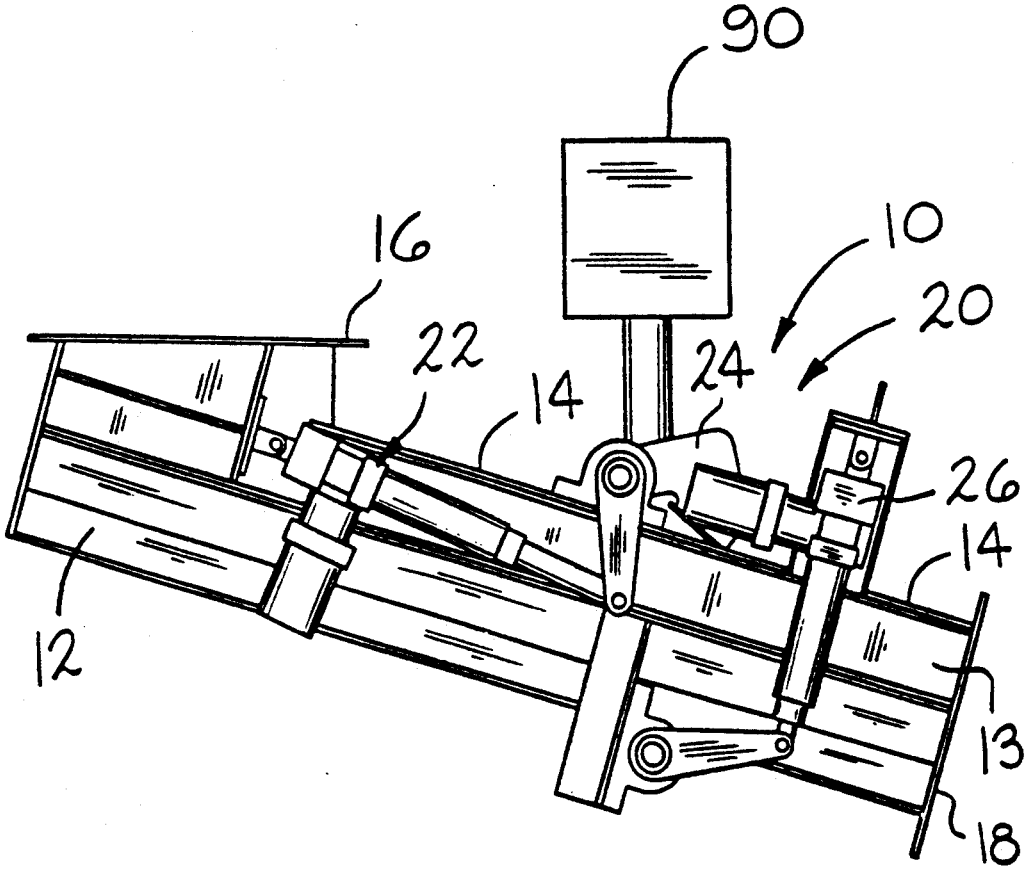
FIG. 1 is an elevation view of one embodiment of an apparatus of the invention for sequentially gravity feeding grinding balls one-at-a-time into a grinding mill.
Figure 2:
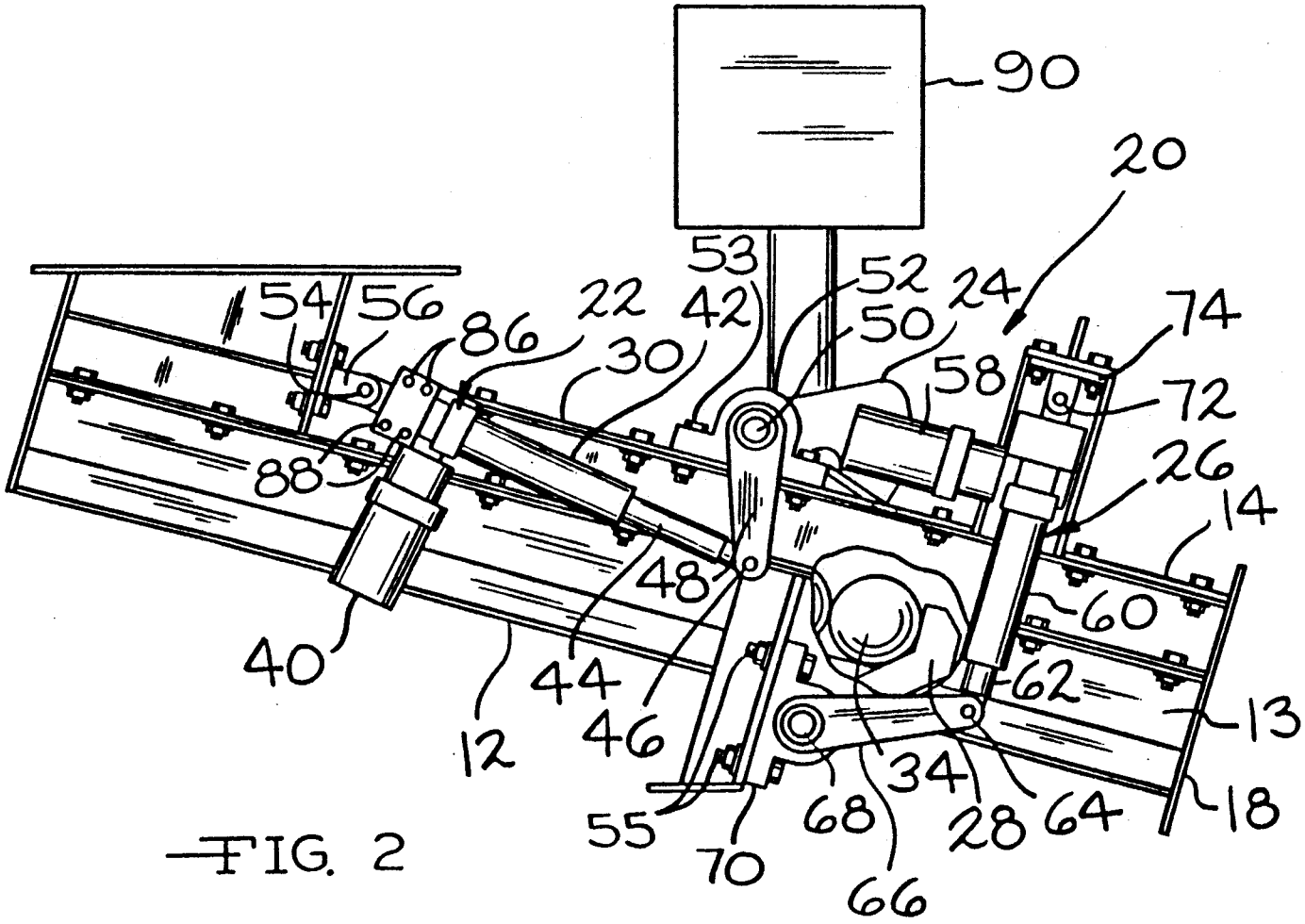
FIG. 2 is a more detailed elevation view, partially in section, of the apparatus of FIG. 1.

Referring to FIG. 1, reference numeral 10 denotes an apparatus for feeding balls by gravity, particularly large diameter balls of equal diameter, into a grinding mill. It will be understood by large diameter balls is meant grinding media of the type having a generally spherical shape whose diameter is about 9 cm or more that will roll by gravity through the feeding apparatus to the grinding mill. The preferred ball diameters are about 13–15 cm. Apparatus 10 includes a downwardly inclined chute 12 and means 20 for sequentially feeding the balls, one-at-a-time, into a grinding mill (not shown). Preferably, the balls are formed from forged or cast magnetic ferrous based material such as steel or iron. Chute 12 includes a pair of sidewalls 13, a cover plate 14, an inlet 16 adapted for receiving grinding balls from means for storing the balls such as a bin or hopper (not shown) and an outlet 18 for discharging the balls to the grinding mill. Feeding means 20 is adapted for use with chute 12 and includes a first actuator 22 having a rotationally mounted extension arm 24 and a second actuator 26 having a rotationally mounted extension arm 28 (FIG. 2). Extension arms 24 and 28 are mounted for rotation in a plane parallel to the longitudinal axis of chute 12. Extension arm 24 is operated for restraining balls in chute 12 and in conjunction with arm 28 for isolating the lowermost ball in the chute to be fed next to the grinding mill. Extension arm 28 is operated for releasing the isolated ball.

FIG. 2 illustrates in detail a preferred embodiment of actuators 22 and 26 of feeding means 20. Actuator 22 includes extension arm 24, a motor 40, a tube 42 for supporting a ram 44 and an actuator arm 48 connected to ram 44 by a pin 46. Actuator arm 48 is journaled on a shaft 50 mounted to a pillow block 52. Pillow block 52 is connected to cover plate 14 of chute 12 by bolts 53. The back end of tube 42 is structurally supported by being connected by a pin 54 to a clevis bracket 56 which also is connected to the chute. Actuator 26 is similar to actuator 22 and includes extension arm 28, a motor 58, a tube 60 for supporting a ram 62 and an actuator arm 66 connected to ram 62 by a pin 64. Actuator arm 66 is journaled on a shaft 68 mounted to a pillow block 70. Pillow block 70 is connected to one of sidewalls 13 of chute 12 by bolts 55. The back end of tube 60 is structurally supported by being connected by a pin 72 to a clevis bracket 74 which is mounted to cover plate 14 downstream from pillow block 52. Actuators 22 and 26 are Mini-Pac electromechanical actuators available from Duff-Norton of Charlotte, N.C. Actuators 22 and 26 include built in upper and lower limit switches 86 and 88 respectively located in the back end of tubes 42 and 60. Alternatively, hydraulically operated actuators could be used. Motors 40 and 58 are 115 volt A.C., 60 Hz electric motors. Plate 14 includes a removable portion 30 allowing an operator access to the inside of chute 12 in the unlikely event that a jamming condition occurs.

Figure 3:
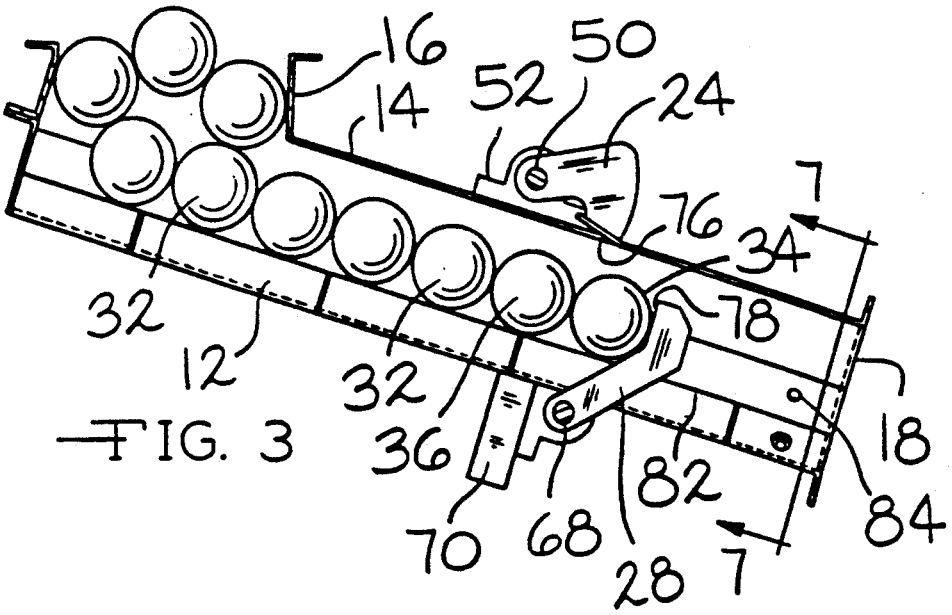
FIG. 3 is a longitudinal section view along the chute of the apparatus of FIG. 2 illustrating an initial position of the actuator extension arms.

FIG. 3 illustrates extension arm 24 of actuator 22 having a stop surface 76 and extension arm 28 of actuator 26 having a stop surface 78. Extension arm 24 is illustrated in a retracted or up position above chute 12 and extension arm 28 is illustrated in an up position for restraining grinding balls 32 from rolling by gravity downwardly along chute 12.

Figure 4:
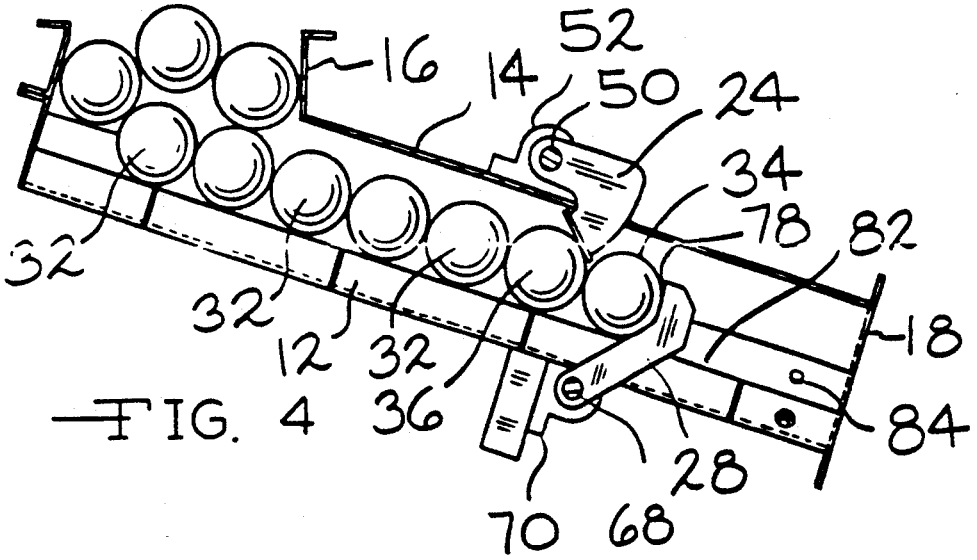
FIG. 4 is the same as FIG. 3 except the first extension arm is rotated to its downward position for isolating the lowermost grinding ball in the chute.

FIG. 4 illustrates extension arm 24 of actuator 22 being in a downward position with stop surface 76 contacting a grinding ball 36 thereby restraining the upstream balls from rolling along chute 12. In this downward position, extension arm 24 works in conjunction with extension arm 28 for isolating lowermost ball 34 from the upstream balls.

Figure 5:
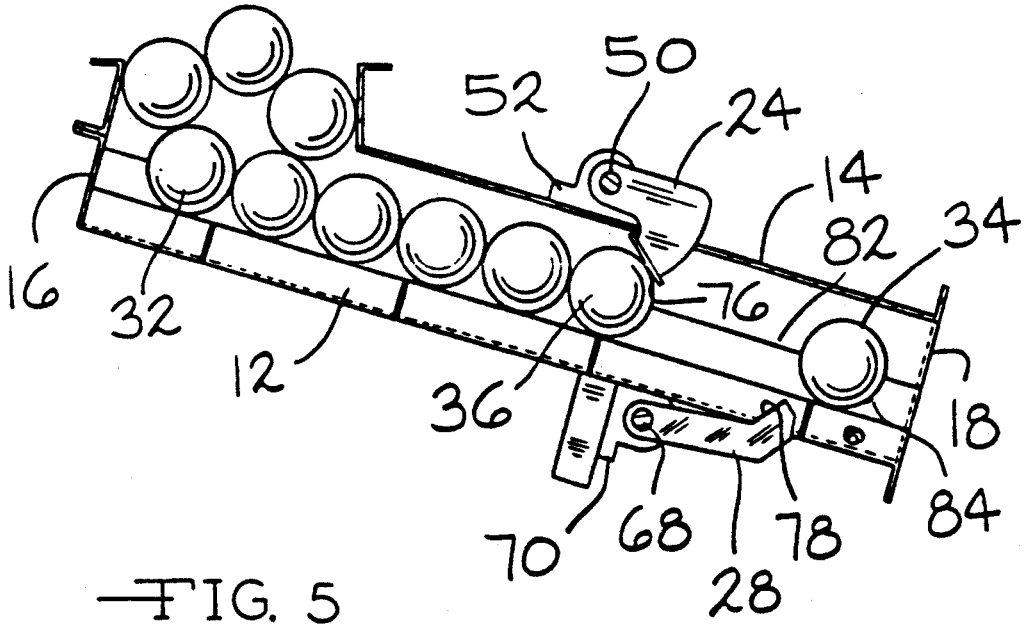
FIG. 5 is the same as FIG. 4 except the second extension arm has been rotated to its downward position with the isolated grinding ball having been released for travel to the grinding mill.

FIG. 5 illustrates extension arm 28 of actuator 26 being retracted to a downward position allowing isolated ball 34 to roll past stop surface 78 and continue rolling by gravity down chute 12 thereby becoming discharged from outlet 18 to the grinding mill. Stop surface 76 of extension arm 24 continues to restrain ball 36 and balls 32 in chute 12 until extension arm 28 is rotated to the position shown in FIG. 4. After extension arm 28 is rotated to the position shown in FIG. 4, extension arm 24 may be rotated to the retracted position shown in FIG. 3. Once extension arm 24 is retracted, ball 36 and balls 32 roll downwardly along the chute until ball 36 moves to the position formerly occupied by ball 34 illustrated in FIG. 4 being restrained by stop surface 78. Ball 36 becomes the next ball to be fed to the grinding mill.

Although motors 40 and 58 of actuators 22 and 26 can be manually operated, feeding means 20 preferably includes a locally mounted computer controller 90. Since the grinding ball attrition rate for a grinding mill is known, computer controller 90 can be programed to sequentially feed grinding balls, one-at-a-time, at the predetermined attrition rate. For example, controller 90 can be programed to feed a single ball at time intervals as short as about 20 seconds to as long as about 45 minutes.

Figure 6:
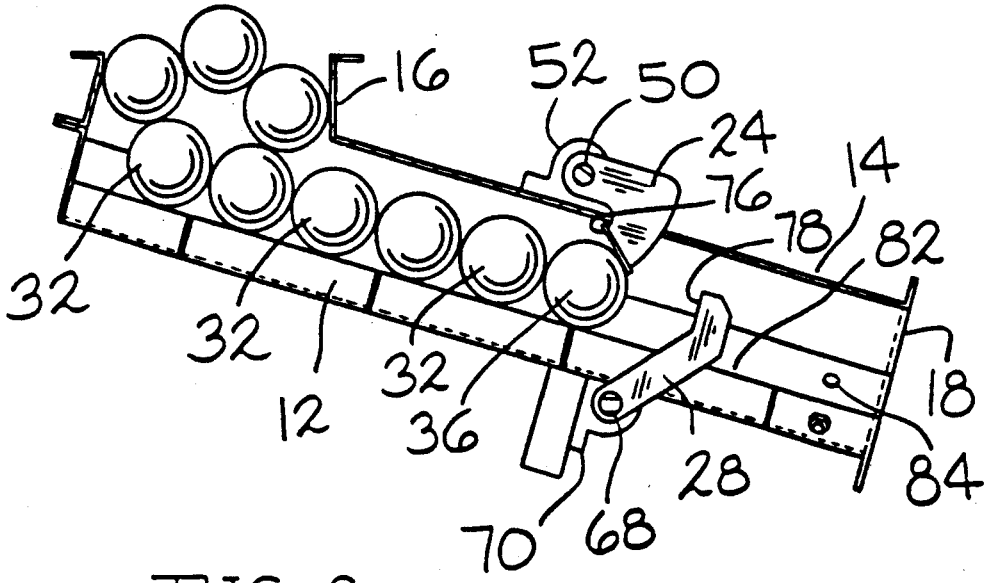
FIG. 6 is the same as FIG. 5 except the second extension arm has been rotated to its upward position with the feeding cycle ready to be repeated.
Figure 7:
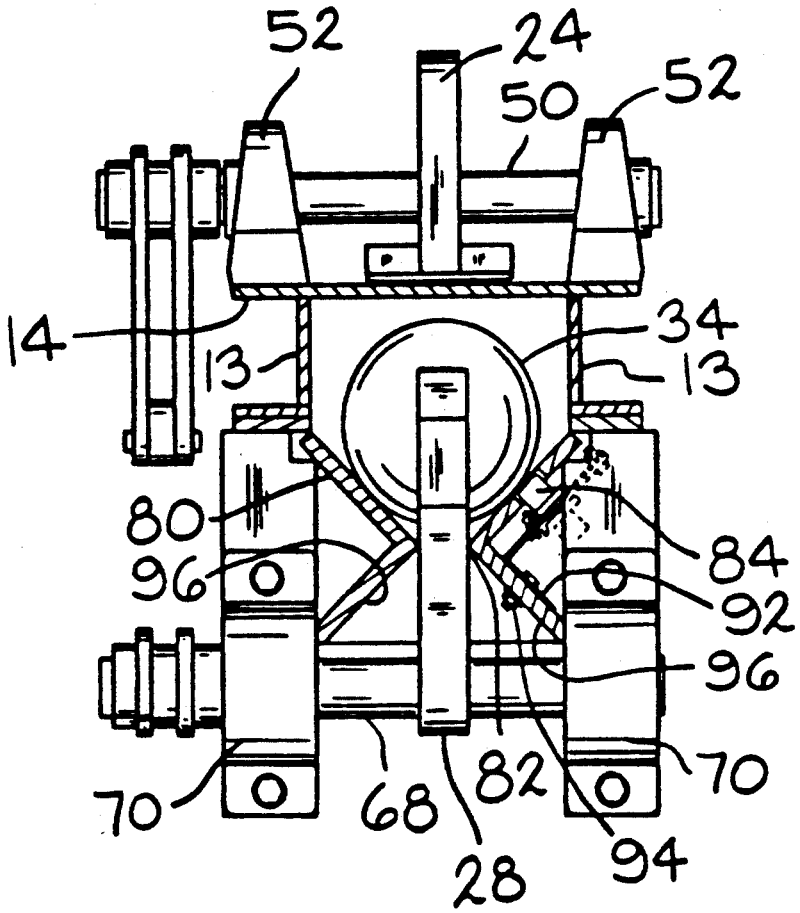
FIG. 7 is a cross sectional view along line 7—7 of FIG. 3 illustrating the lowermost grinding ball being held by the second extension arm.

The lower travel surface of chute 12 preferably is contoured so that grinding balls supplied to the chute from the storage means are encouraged to travel downwardly through the chute in single file. FIG. 7 illustrates chute 12 having a V-shaped contour surface 80. Surface 80 includes a centrally located slot 82 allowing upward travel by extension arm 28 when extension arm 28 is rotated to the upward position shown in FIGS. 3, 4 and 6. A magnetic sensor 84 is positioned on chute 12 downstream from actuators 22 and 26 near outlet 18 for detecting release of the isolated ball by feeding means 20 and for providing feedback to the controller indicating successful passage of the ball from the chute to the grinding mill. Sensor 84 is mounted to an L-shaped bracket 92 connected by a bolt 94 to a flange 96 of surface 80. Sensor 84 preferably is adjustable within chute 12 for detecting passage of a ball to the grinding mill. The position of the sensor can be adjusted using lock washers mounted on the sides of the L-shaped bracket. An important feature of this embodiment is a ball feeding apparatus that not only monitors each ball fed but also serves as an alarm. In the unlikely event that a jamming condition occurs, sensor 84 notifies the operator such as by sounding a horn or illuminating a strobe that a ball has not passed to the grinding mill at the predetermined time. This occurs when extension arms 24 and 28 are cycled but the passage of a ball past sensor 84 is not detected.

A major advantage of the invention is the possibility of ball jamming within the feeding mechanism has been minimized or eliminated because a conventional rotating feeding device has been replaced by the actuated extension arms. Furthermore, side-by-side wedging of the balls within the chute has been minimized or eliminated because the balls are singly conveyed down the contoured surface of the chute. FIG. 7 illustrates the vertical distance between cover plate 14 and contoured surface 80 and the horizontal distance between sidewalls 13 of chute 12 define a cross sectional area sufficiently small so that the balls are conveyed through the chute in single file. In the unlikely event a jamming situation occurs in chute 12, the jammed ball or ball fragment can be removed easily by removing access portion 30 of plate 14.

The apparatus of the invention is especially suited for feeding balls of the same size of relatively large diameter. The horizontal distance between shaft 50 of pillow block 52 and shaft 68 of pillow block 70 corresponds approximately to the diameter of the balls. When it is desired to feed balls of different size, the distance between shafts 50 and 68 must be adjusted. This is easily accomplished by repositioning pillow block 52. In the embodiment illustrated, pillow block 52 is connected to cover plate 14 by bolts 53. Cover plate 14 conveniently is provided with longitudinally extending slots so that pillow block 52 can be repositioned along chute 12 once mounting bolts 53 have been loosened.

An example demonstrating operation of the grinding ball feeding apparatus of the invention now will be described. In a 4500 MT/day mill for grinding gold ore using 12.7 cm diameter steel grinding balls, the known attrition rate of grinding balls is 200 g/MT. Computer controller 90 with feeding means 20 for sequentially operating motors 40 and 58 can be set so that one grinding ball is fed into the mill about every 13 minutes. At the predetermined time, extension arm 28 of actuator 26 is retracted to the downward position allowing the isolated grinding ball in the chute to roll by gravity to the grinding mill. Simultaneously, extension arm 24 restrains the next and remaining balls in the chute. As soon as passage of the isolated ball is detected by sensor 84, extension arm 28 is rotated to the up position illustrated in FIG. 6. Extension arm 24 is then retracted to the up position illustrated in FIG. 3. The balls roll downwardly in the chute until lowermost ball 36 contacts stop surface 78 on extension arm 28. Extension arm 28 restrains the balls in the chute while extension arm 24 is rotated to the downward position illustrated in FIG. 4. The ball feeding cycle is then repeated.

It will be understood various modifications may be made to the invention without departing from the spirit and scope of it. Therefore, the limits of the invention should be determined from the appended claims.

What is claimed is:

1. An apparatus for feeding steel or iron balls to a grinding mill, comprising: a grinding mill;

a downwardly inclined chute adapted for receiving the balls from a storage means, the chute including a contoured ball travel surface for delivering the balls to the grinding mill, means for sequentially feeding the balls, one-at-a-time, to the grinding mill, the feeding means including a first actuator, a second actuator and a computer controller for operating each of the actuators at a predetermined time interval corresponding to the ball attrition rate of the grinding mill, each of the actuators including an extension arm mounted for rotation in a plane parallel to the longitudinal axis of the chute, the extension arm of the first actuator for restraining the balls in the chute and for working in conjunction with the second actuator for isolating the next ball to be fed to the grinding mill, the extension arm of the second actuator for releasing the isolated ball to the grinding mill and means for magnetically sensing passage of the isolated ball from the chute thereby providing feedback to the controller.

2. The apparatus of claim 1 including a pair of motors, a different one of the motors for operating each of the actuators.

3. The apparatus of claim 1 wherein the travel surface is V-shaped.

4. The apparatus of claim 3 wherein the ball travel surface includes a centrally located slot for travel of the second extension arm.

5. The apparatus of claim 1 wherein the balls are of equal diameter.

* * * * *